US008974879B2

(12) United States Patent
Kobayashi et al.

(10) Patent No.: US 8,974,879 B2
(45) Date of Patent: Mar. 10, 2015

(54) IMAGE TRANSFER SHEET AND IMAGE RECORDING MATERIAL

(71) Applicant: Fuji Xerox Co., Ltd., Tokyo (JP)

(72) Inventors: Tomoo Kobayashi, Kanagawa (JP); Naoyuki Egusa, Kanagawa (JP); Tetsuro Kodera, Kanagawa (JP); Kaoru Torikoshi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 18 days.

(21) Appl. No.: 13/779,222

(22) Filed: Feb. 27, 2013

(65) Prior Publication Data

US 2013/0319270 A1 Dec. 5, 2013

(30) Foreign Application Priority Data

Jun. 1, 2012 (JP) ..... 2012-126526

(51) Int. Cl.

| | |
|---|---|
| ***B41M 5/382*** | (2006.01) |
| ***B41M 5/42*** | (2006.01) |
| ***B44C 1/17*** | (2006.01) |
| ***B41M 5/025*** | (2006.01) |
| ***B41M 5/50*** | (2006.01) |
| ***B41M 7/00*** | (2006.01) |

(52) U.S. Cl.

CPC ..... *B41M 5/025* (2013.01); *B41M 2205/32* (2013.01); *B41M 5/38257* (2013.01); *B41M 2205/38* (2013.01); *B44C 1/1725* (2013.01); *B41M 5/42* (2013.01); *B41M 5/502* (2013.01); *B41M 7/0027* (2013.01); *B41M 2205/10* (2013.01)

USPC ..... 428/32.51; 428/32.78; 428/32.8; 428/32.81; 427/152; 156/235; 156/239; 156/240

(58) Field of Classification Search

CPC ..... B41M 5/38257; B41M 5/42; B41M 2205/10; B41M 2205/32; B41M 2205/38; B44C 1/177; B44C 1/1725

USPC ..... 428/32.51, 32.78, 32.8, 32.81; 427/152; 156/235, 239, 240

See application file for complete search history.

(56) References Cited

U.S. PATENT DOCUMENTS 5,824,420 A 10/1998 Dobashi et al.
5,841,462 A 11/1998 Matsuo et al.

(Continued)

FOREIGN PATENT DOCUMENTS

JP 5-96871 A 4/1993
JP 7-68812 A 3/1995

(Continued)

OTHER PUBLICATIONS

Communication from the Japanese Patent Office dated Jan. 15, 2013, in a counterpart application No. 2012-126526.

(Continued)

*Primary Examiner* — Bruce H Hess
(74) *Attorney, Agent, or Firm* — Sughrue Mion, PLLC

(57) ABSTRACT

There is provided an image transfer sheet, including: an image receiving layer; a bonding layer; a transparent support; and a substrate, in this order, wherein a peeling strength between the transparent support and the substrate is lower than a peeling strength between the image receiving layer and the bonding layer, and between the bonding layer and the transparent support.

3 Claims, 3 Drawing Sheets

(56) References Cited

U.S. PATENT DOCUMENTS

| | | | | |
|---|---|---|---|---|
| 6,004,658 | A | 12/1999 | Owada et al. | |
| 7,438,959 | B2 * | 10/2008 | Kometani et al. | 428/32.51 |

FOREIGN PATENT DOCUMENTS

| | | | |
|---|---|---|---|
| JP | 8-142365 | A | 6/1996 |
| JP | 8-156302 | A | 6/1996 |
| JP | 9-314875 | A | 12/1997 |
| JP | 11-291646 | A | 10/1999 |
| JP | 11-334265 | A | 12/1999 |
| JP | 2001-92255 | A | 4/2001 |
| JP | 2009-143194 | A | 7/2009 |
| JP | 2009276483 | A | 11/2009 |
| JP | 2010-005885 | A | 1/2010 |
| JP | 2010-128061 | A | 6/2010 |

OTHER PUBLICATIONS

Office Action issued by the Japanese Patent Office in corresponding Japanese Patent application No. 2012126526, dated Apr. 9, 2013.

* cited by examiner

IMAGE TRANSFER SHEET AND IMAGE RECORDING MATERIAL

CROSS-REFERENCE TO RELATED APPLICATION(S)

This application is based on and claims priority under 35 U.S.C. 119 from Japanese Patent Application No. 2012-126526 filed on Jun. 1, 2012.

BACKGROUND

1. Technical Field

The present invention relates to an image transfer sheet and an image recording material.

2. Related Art

With the recent advance of image forming techniques, there are known methods for forming high quantity of images with equivalent print qualities at low cost by using various printing techniques, such as intaglio printing, relief printing, flat printing, rotogravure printing, screen printing, and so on. These printing techniques are also widely used in the fabrication of data recording media, including, for example, IC cards, magnetic stripe cards, optical cards, or IC/magnetic/optical cards, which can hold given data and perform contact or non-contact communications with external equipment.

The image forming method which is now predominantly used in the printing technique in need for individual prints of personal identification data (for example, the holder's photograph, name, address, date of birth, different licenses, etc.) is the use of thermal transfer printers, which employ sublimation transfer printing with ink ribbons, or fusion transfer printing.

In addition, JP-A-H5-96871, JP-A-H7-68812, JP-A-H8-142365, JP-A-H8-156302, JP-A-H9-314875, and JP-A-H11-291646 disclose a method of making a print on an image recording material using an intermediate transfer material in the thermal transfer printing system.

In this regard, the image forming (printing) process using the electrophotographic printing system involves applying an electrostatic charge on the surface of an image carrier, exposing the surface of the image carrier to light according to an image signal to form an electrostatic latent image by the potential difference between the exposed portion and the non-exposed portion, and then performing an electrostatic development using a color powder (i.e., an image forming material) called "toner" having the polarity opposite to the potential of the charges on the image carrier to form a visible image (i.e., a toner image) on the surface of the image carrier. For color printing, this process is conducted repeatedly multiple times, or a plurality of image forming units are arranged in parallel, to form a visible image in color, which image is then transferred and fused fixed, primarily by thermal melting and cooling of color powder) onto the surface of the image carrier.

Further. JP-A-2001-92255 specifies a method of printing any kind of personal information or invisible bar codes on a 250 μm thick polyvinyl chloride sheet or a 280 μm thick polyester sheet by electrophotographic printing, laying an over-film on the top of the printed side of the sheet, and then making a laminate by using a heat transfer press machine.

Further, JP-A-H11-334265 describes a method of printing personal identification information on a light-permeable sheet, where the printing is conducted in a way to form a mirror image. It is also stated that at least part of the light-permeable laminate sheet preferably includes a biaxially stretched polyester film, an acrylonitrile butadiene styrene (ABS) or polyester film/biaxially stretched polyester film, and that the light-permeable laminate sheet may also include polyvinyl chloride.

Further, JP-A-2010-128061 discloses a method of forming an image on the surface side of an image transfer sheet on which an image receiving layer is disposed, and fabricating an image recording material, where the image transfer sheet includes the image receiving layer, a transparent support, and a substrate in this order, and the transparent support and the substrate are removable by peeling.

It is an object of the present invention to provide an image transfer sheet having a transparent support prevented from peeling when used for an image recording material.

SUMMARY

The object can be achieved by the present invention described below as follows.

(1) An image transfer sheet, including: an image receiving layer; a bonding layer; a transparent support; and a substrate, in this order, wherein a peeling strength between the transparent support and the substrate is lower than a peeling strength between the image receiving layer and the bonding layer, and between the bonding layer and the transparent support.

BRIEF DESCRIPTION OF DRAWINGS

Exemplary embodiments of the present invention will be described in detail based on the following figures, wherein.

DETAILED DESCRIPTION

Hereinafter, a detailed description will be given as to an exemplary embodiment of the present invention.

<Image Transfer Sheet>

The image transfer sheet (hereinafter, simply referred to as "transfer sheet" in some cases) according to the exemplary embodiment of the present invention has an image receiving layer, a bonding layer, a transparent support, and a substrate in this order, where the peeling strength between the transparent support and the substrate is lower than the peeling strength between the image receiving layer and the bonding layer and between the banding layer and the transparent support.

Conventionally, the fabrication process for an image recording material, such as IC cards, by using a transfer sheet involves funning an image on the surface of the image receiving layer by electrophotography or the like on a transfer sheet having an image receiving layer, a transparent support, and a substrate, laminating the transfer sheet on an image support, conducting heat compression, and then peeling the substrate off to transfer the image receiving layer and the transparent support onto the image support and thus complete an image recording material.

In some cases, however, the transparent support having a function of a surface protective layer may peel off the conventional image recording material, more frequently under circumstances when the temperature drops to 10° C. or below, such as in wintertime.

Contrarily, the transfer sheet according to an exemplary embodiment of the present invention is formed to have a bonding layer disposed between an image receiving layer and a transparent support. The existence of the bonding layer strengthens the adhesion between the image receiving layer and the transparent support, and the image support fabricated by using such a transfer sheet may have the transparent support effectively prevented from being peeled off.

Subsequently, a detailed description will be given as to the individual layers constituting the transfer sheet according to the exemplary embodiment of the present invention.

The layer construct of the image transfer sheet according to the exemplary embodiment of the present invention is not specifically limited as long as it has an image receiving layer, a bonding layer, a transparent support, and a substrate. For example, an adhesive layer is preferably disposed between the transparent support and the substrate, in view of making it easier to peel the substrate off when transferring the image receiving layer, the bonding layer, and the transparent support onto the image support.

Hereinafter, a detailed description will be given as to a constructional example of the transfer sheet according to the exemplary embodiment of the present invention with reference to the accompanying drawings. The constructional example of the transfer sheet according to the exemplary embodiment of the present invention is not, however, intended to limit the construction that is to be illustrated herein.

Figure 1:
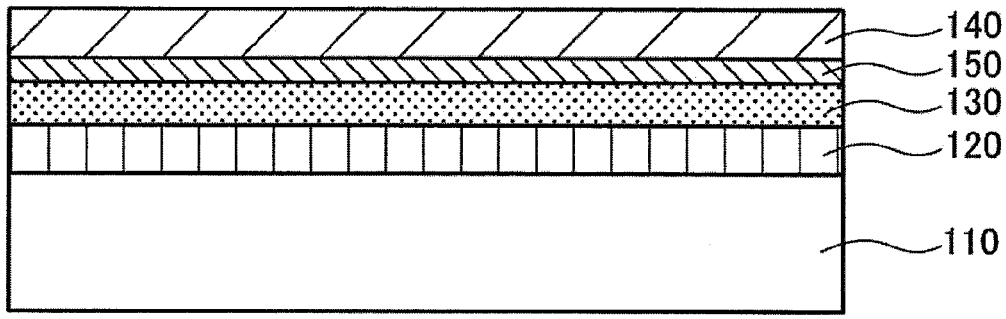
FIG. 1 is a cross-sectional, view showing an example of the image transfer sheet according to an exemplary embodiment of the present invention.

FIG. 1 is a schematic perspective showing an example of the image transfer sheet according to an exemplary embodiment of the present invention. The image transfer sheet according to an exemplary embodiment of the present invention as illustrated in FIG. 1 includes a substrate 110, an adhesive layer 120, a transparent support 130, a bonding layer 150, and an image receiving layer 140.

Peeling Strength

The transfer sheet according to an exemplary embodiment of the present invention is designed to have the peeling strength between the transparent support 130 and the substrate 110 lower than the peeling strength between the image receiving layer 140 and the bonding layer 150 and between the bonding layer 150 and the transparent support 130. Hence, pulling out the ends of the outermost layers on both sides of the transfer sheet (i.e., the substrate 110 and the image receiving layer 140 in the transfer sheet shown in FIG. 1) ends up peeling the transparent support 130 and the substrate 110 apart from each other.

Particularly in the exemplary embodiment of the present invention, as shown in FIG. 1, the adhesive layer 120 is preferably disposed in a region between the transparent support 130 and the substrate 110, and the peeling strength between the transparent support 130 and the adhesive layer 120 is preferably weaker than any other peeling strength in the interfaces, including:

(A) between the image receiving layer 140 and the bonding layer 150, (B) between the bonding layer 150 and the transparent support 130, and (C) between the adhesive layer 120 and the substrate 110.

In other words, when pulling out each end of the outermost layers on both sides of the transfer sheet (i.e., the substrate 110 and the image receiving layer 140 in the transfer sheet shown in FIG. 1), the united portion of the image receiving layer 140, the bonding layer 150, and the transparent support 130 is preferably peeled of the united portion of the adhesive layer 120 and the substrate 110.

Furthermore, all the constituent layers on the surface of the one side of the interface to be peeled apart are preferably peeled off of all the constituent layers on the surface of the other side without causing a partial release.

Here, the peeling strength (N/cm) in each interface between the constituent layers of the transfer sheet is measured as follows.

Firstly, a 25 mm wide sample is cut out of the transfer sheet. Each end of the outermost layers on both sides of the sample (i.e., the substrate 110 and the image receiving layer 140 of the transfer sheet shown in FIG. 1) is pulled out. Because the sample is peeled apart in the interface of which the peeling strength is lowest, the transparent support 130 is separated from the substrate 110 in the transfer sheet according to the exemplary embodiment of the present invention.

In this manner, the sample is peeled apart 6 mm in the interface having the lowest peeling strength. Each end of the sample is loaded into opposing tensile grips (e.g., chucks or clamps) of a tensile test machine, and the grips are separated at a constant rate of speed, 300 mm/min, to measure the 180 degree peeling strength (unit: N/cm).

The measurement is performed according to the JIS-X6305.

As the interface with the lowest peeling strength is completely peeled apart in such a manner as described above, the sample is separated into two sample pieces.

For the transfer sheet shown in FIG. 1, for example, a peeling in the interface between the transparent support 130 and the adhesive layer 120 ends up with the sample being separated into a sample piece including the substrate 110 and the adhesive layer 120 and a sample piece including the image receiving layer 140, the bonding layer 150, and the transparent support 130.

Then, each end of the outermost layers on both sides of the one sample piece (i.e., the image receiving layer 140 and the transparent support 130 in the case where the sample piece includes the image receiving layer 140, the bonding layer 150, and the transparent support 130) is pulled out. The sample piece is peeled apart 6 mm, if any, in the peeling interface. Each end of the sample piece is loaded into opposing tensile grips (e.g., chucks or clamps) of a tensile test machine, and the grips are separated at a constant rate of speed, 300 mm/min, to measure the 180 degree peeling strength (unit: N/cm).

Further, the same peeling procedures are performed on the other sample piece (i.e., the sample piece including the substrate 110 and the adhesive layer 120) to measure the peeling strength in the peeling interface, if any.

In the case of the transfer sheet illustrated in FIG. 1, adhesion strength enough not to break is formed in the interfaces between the substrate 110 and the adhesive layer 120, between the transparent support 130 and the bonding layer 150, and between the bonding layer 150 and the image receiving layer 140. Therefore, the peeling strength in the interface not peeling apart is considered to be stronger than the peeling strength in the interface measurable by the aforementioned method.

Further, the peeling strength measurement using the above-described method may be conducted after forming an image on the image receiving layer of the transfer sheet and laminating the surface side of the image receiving layer on the image support.

Further, the peeling strengths between the image receiving layer and the bonding layer 150 and between the bonding layer 150 and the transparent support 130 are preferably 6 N/cm or greater, more preferably 10 N/cm or greater, further more preferably 15 N/cm or greater, in view of effectively preventing the transparent support from being peeled off of the image recording material. Further, the upper limit of the peeling strength is preferably, if not specifically limited to, 100 N/cm or less.

Further, the peeling strength between the transparent support 130 and the substrate 110 is preferably 1 N/cm or less, more preferably 0.1 N/cm or less, further more preferably 0.03 N/cm or less, in view of making it easier to peel the substrate off when transferring the image receiving layer and the transparent support onto the image recording material. Further, if not specifically limited, the lower limit of the peeling strength is preferably given as not to cause a peeling during the normal handling procedure (for example, lifting by hand, setting into a machine, conveying inside a machine, etc.).

In addition, if the transfer sheet has the adhesive layer 120 as shown in FIG. 1, the peeling strength between the transparent support 130 and the adhesive layer 120 is preferably within the above-defined range in view of making it easier to peel off the substrate and the adhesive layer when transferring the image receiving layer, the bonding layer, and the transparent support onto the image recording material.

(Image Receiving Layer)

Thermoplastic Resin

The image receiving layer disposed on the surface of the transfer sheet preferably includes, for example, a thermoplastic resin. The examples of the thermoplastic resin may include, but are not specifically limited to, homopolymers or copolymers obtained by polymerizing at least any one or two of styrenes, such as styrene, vinylstyrene, chlorostyrene, etc.; mono-olefins, such as ethylene, propylene, butylene, isobutylene etc.; vinylesters, such as vinyl acetate, vinyl propionate, vinyl benzoate, vinyl butyrate, etc.; esters of α-unsaturated fatty acid monocarboxylate, such as methyl acrylate ethyl acrylate, butyl acrylate, dodecyl acrylate, octyl acrylate, phenyl acrylate, methyl methacrylate, ethyl methacrylate butyl methacrylate dodecyl methacrylate, etc.; vinyl ethers, such as vinyl methyl ether, vinyl ethyl ether, vinyl butyl ether, etc.; vinyl ketones, such as vinyl methyl ketone, vinyl hexyl ketone, vinyl isopropenyl ketone, etc.; or diene-based monomers, such as isoprene, 2-chlorobutadiene etc.

Among these resins, styrenes, esters of α-unsaturated fatty acid monocarboxylate, or the like are preferably used.

Further, the thermoplastic resin usable in the exemplary embodiment of the present invention is preferably a polyester-based resin which is used as an image forming material, in view of adequately controlling the fixability of the image forming material on the surface of the transfer sheet by including a resin of the same type in the image receiving layer.

Further, the polyester-based resin may include, as well as normal polyester resins, silicone-modified polyester resins, urethane-modified polyester resins, acryl-modified polyester resins, and so on. Further, these polyester resins may be used alone or as a mixture of two or more.

The polyester-based resin is prepared by reaction between a polyhydroxy compound and a polybasic carboxylic acid or its reactive acid derivative. The examples of the polyhydroxy compound constituting polyesters may include diols such as ethylene glycol, diethylene glycol, triethylene glycol, 1,2-propylene glycol, 1,3-propylene glycol, neopentyl glycol, 1,4-butanediol, etc.; bisphenol A alkylene oxide adducts, such as hydrogenated bisphenol A, polyoxyethylene bisphenol A, polyoxypropylene bisphenol A, etc.; or other dihydric alcohols or dihydric phenols of bisphenol A.

Further, the examples of the polybasic carboxylic acid may include malonic acid, succinic acid, adipic acid, sebacic acid, alkyl succinic acid, maleic acid, fumaric acid, mesaconic acid, citraconic acid, itaconic acid, glutaconic acid, cyclohexane dicarboxylic acid, phthalic acid (e.g., isophthalic acid or terephthalic acid), or other reactive acid derivatives, such as dihydric carboxylic acids or their acid anhydrides, alkyl esters, or acid halides.

In addition to these dihydroxy compounds and dihydric carboxylic acids, any polyhydroxy fat least trihydroxy) compound or polybasic (at least tribasic carboxylic acid may be added to the resultant thermoplastic resin, with a view to nonlinearization of the thermoplastic resin to the extent not to form a substance insoluble to tetrahydroxyfuran.

The content (solid ratio) of the thermoplastic resin in the image receiving layer is preferably from 60 mass % to 100 mass %, more preferably from 75 mass % to 95 mass %.

Other Ingredients

Furthermore, the resin constituting the image receiving layer may include curable resins, such as thermosetting resins, light curing resins, electron beam (EB) curing resins, and so forth.

Further, the image receiving layer may contain a release agent, such as natural or synthetic waxes, release resins, reactive silicone compounds, modified silicone oils, and so forth.

More specifically, the examples of the natural or synthetic waxes may include, but are not specifically limited to, natural waxes, such as carnauba wax, beeswax, montan wax, paraffin wax, microcrystalline wax, etc.; or synthetic waxes, such as low molecular weight polyethylene wax, low molecular weight oxidized polyethylene wax, low molecular weight polypropylene wax, low molecular weight oxidized polypropylene wax, higher fatty acid wax, higher fatty acid ester wax, sasol wax, etc., which waxes may be used alone or as a mixture of two or more.

Further, the examples of the release resins may include silicone resins; fluorine resins; modified silicone resins which are a modification of silicone resins and any other resin, such as, for example, polyester-modified silicone resin, urethane-modified silicone resin, acryl-modified silicone resin, polyimide-modified silicone resin, olefin-modified silicone resin, ether-modified silicone resin, alcohol-modified silicone resin, fluorine-modified silicone resin, amino-modified silicone resin, mercapto-modified silicone resin, carboxy-modified silicone resin, etc.; thermosetting silicone resins; or light curing silicone resins.

Further, the release agent as used in the exemplary embodiment of the present invention may be a modified silicone oil mixed with a reactive slime compound.

These waxes or release resins may coexist in a state of particles or the like, but may be preferably used as added in a thermoplastic resin, as dispersed in a resin, as compatibilized in a resin, or as introduced into a thermoplastic resin.

Preferably in the exemplary embodiment of the present invention, the image receiving layer may also contain a filler.

The examples of the filler as used in the exemplary embodiment of the present invention, if made up of organic resin particles, may include, but are not specifically limited to, homopolymers or copolymers obtained by polymerizing at least one of styrenes, such as styrene, vinyl styrene, chlorostyrene, etc.; mono-olefins, such as ethylene, propylene, butylene isobutylene, etc.; vinyl esters, such as vinyl acetate, vinyl propionate, vinyl benzoate, vinyl butyrate, etc.; esters of α-unsaturated fatty acid monocarboxylic acid, such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate etc.; vinyl ethers, such as vinyl methyl ether, vinyl ethyl ether, vinyl butyl ether, etc.; vinyl ketones, such as vinyl methyl ketone, vinyl hexyl ketone, vinyl isopropenyl ketone, etc.; or diene-based monomers, such as isoprene, 2-chlorobutadiene, etc.

Among these fillers, esters of α-unsaturated fatty acid monocarboxylic acid are preferred. Preferably, the thermoplastic resins, when used as a filler, is coated with a solvent which does not dissolve them. More preferably, thermosetting resins with a cross-linked structure prepared by adding a crosslinking agent to the hotmelt resins, or the above-mentioned thermosetting resins, light curing resins, or electron beam (EB) curing resins are used in the form of particles.

The examples of the filler, if made up of inorganic particles, may include mica, talc, silica, calcium carbonate, zinc oxide, halloysite clay, kaolin, hydrated and hydrochloric acid magnesium carbonate, quartz powder, titanium dioxide, barium sulfate, calcium sulfate, alumina, and so forth.

The particle shape of the filler is generally spherical but may also be platey, spicule, or indeterminate.

Further, the volume average particle diameter of the filler is preferably from 0.1 μm to 30 μm, which is preferably 1.2 or more times greater than the thickness of the image receiving layer;

In the image receiving layer of the image transfer sheet, the weight ratio of filler to binding agent (resin component) is preferably in the range of 0.01:100 to 15:100, more preferably in the range of 0.5:100 to 5:100.

The filler may be used in combination with other inorganic particles (for example, $SiO_2$, $Al_2O_3$, talc, or kaolin) or bead type plastic powder (for example, cross-linked PMMA, polycarbonate, polyethylene terephthalate, or polystyrene).

(Transparent Support)

Hereinafter, a description will be given as to the transparent support as used in the exemplary embodiment oldie present invention.

The transparent support is typically made of plastic films. The preferred plastic films are light-permeable films used as OHP films, such as, for example, polyacetate films, cellulose triacetate films, nylon films, polyethylene terephthalate films, polyethylene naphthalate films, polycarbonate films, polysulfone films, polystyrene films, polyphenylene sulfide films, polyphenylene ether films, cyclo-olefin films, polypropylene films, cellophane, acrylonitrile-butadiene-styrene (ABS) resin films, and so on. Among these plastic films, polyethylene naphthalate films, polyethylene terephthalate films, and polyphenylene sulfide films are particularly preferred.

The fabrication method for the transparent support used in the exemplary embodiment of the present invention is optionally chosen but may include a known method, such as coextrusion, lamination, and so on.

In the general fabrication of the transparent support, the coextrusion process is followed by the longitudinal stretching process, where the film is stretched between two or more rolls each having a different tangential speed and wound up to a desired thickness. For biaxial stretching, the film from the above-described processes is directly transferred into a tenter and stretched from 2.5 times to 5 times its original dimension in the width direction. In this regard, the stretching temperature is preferably in the range from 100° C. to 200° C.

The biaxially stretched film thus obtained is then subjected to heat treatment as needed. The heat treatment is preferably carried out in the tenter. Particularly, carrying out the heat treatment at reduced temperature lengthwise and breadthwise may result in production of films with low thermal shrinkage. The biaxially stretched film is particularly preferred as the transparent support.

More preferably, the one side of the transparent support is subjected to a release treatment.

The release treatment involves conducting a surface treatment with a release material. Preferably, the release material is, if not specifically limited to, silicon-based materials. These silicon-based materials may be made of condensate resins at least including a silane-based composition, or a composite composition of the condensate resins and a colloidal silica dispersing solution. Preferably, organic resins are further included.

More specifically, the silane-based composition is an organosilicic compound. The examples of the organosilicic compound may include slime compounds, fluorine-containing silane compounds, or isocyanate silane compounds, which are converted into a resin composition by condensation reaction.

The examples of the silane compounds may include alkoxysilanes, such as $Si(OCH_3)_4$, $CH_3Si(OCH_3)_3$, $HSi(OCH_3)_3$, $(CH_3)_2Si(OCH_3)_2$, $CH_3SiH(OCH_3)_2$, $C_6H_5Si(OCH_3)_3$, $Si(OC_2H_5)_4$, $CH_3Si(OC_2H_5)_3$, $(CH_3)_2Si(OC_2H_5)_2$, $H_2Si(OC_2H_5)_2$, $C_6H_5Si(OC_2H_5)_3$, $(CH_3)_2CHCH_2Si(OCH_3)_3$, $CH_3(CH_3)_{11}Si(OC_2H_5)_3$, $CH_3(CH_2)_{15}Si(OC_2H_5)_3$, $CH_3(CH_2)_{17}Si(OC_2H_5)_3$, etc.; silazanes, such as $(CH_3)_3SiNHSi(CH_3)_3$, etc.; special silylating agents, such as tert-$C_4H_9(CH_3)_2SiCl$, etc.; silane coupling agents; silane compounds; or hydrolysates or partial condensates of these.

The examples of the silane coupling agents may include vinyl silanes, such as vinyl tris(β-methoxyethoxy)silane, vinyl triethoxysilane, vinyl trimethoxysilane, etc.; acryl such as γ-methacryloxypropyl trimethoxysilane, etc.; epoxy silanes, such as β-(3,4-epoxycyclohexyl)ethyl trimethoxysilane, γ-glycidoxypropylmethyldiethoxysilane, etc.; or aminosilanes, such as N-β-(aminoethyl)-γ-aminopropylmethyldimethoxysilane, γ-aminopropyltriethoxysilane, N-phenyl-γ-aminopropyltrimethoxysilane, etc.

The examples of the fluorine-containing silane compounds may include fluorine-containing silane compounds, such as $CF_3(CH_2)_2Si(OCH)_3$, $C_6F_{13}C_2H_4Si(OCH_3)_3$, $C_7F_{15}CONH(CH_2)_3Si(OC_2H_5)_3$, $C_8F_{17}C_2H_4Si(OCH_3)_3$, $C_8F_{17}C_2H_4SiCH_3(OCH_3)_2$, $C_8F_{17}C_2Si(ON{=}C(CH_3)(C_2H_5))_3$, $C_9F_{19}C_2H_4Si(OCH_3)_3$, $C_9F_{19}C_2H_4Si(NCO)_3$, $(NCO)_3SiC_2H_4C_6F_{12}C_6F_{12}C_2H_4Si(NCO)_3$, $C_9F_{19}C_2H_4Si(C_2H_5)(OCH_3)_2$, $(CH_3O)_3SiC_2H_4C_8F_{16}C_2H_4Si(OCH_3)_3$, $(CH_3O)_2(CH_3)SiC_9F_{18}C_2H_4Si(CH_3)(OCH_3)_2$; etc.; or hydrolysates or partial condensates of these.

The examples of the isocyanate silane compounds may include $(CH_3)_3SiNCO$, $(CH_3)_2Si(NCO)_2$, $CH_3Si(NCO)_3$, vinylsilyl triisocyanate, $C_6H_5Si(NCO)_3$, $Si(NCO)_4$, $C_2H_5OSi(NCO)_3$, $C_8H_{17}Si(NCO)_3$, $C_{18}H_{37}Si(NCO)_3$, $(NCO)_3SiC_2H_4(NCO)_3$, etc.

The examples of the condensate resin of silane-based composition in the exemplary embodiment of the present invention may include curable silicone resins, such as thermosetting (condensation/addition) or light curing, silicone resins, etc., the specific examples of which are as follows.

Among the thermosetting silicone resins, the examples of the condensation curable silicone resins may include cure silicon resins synthesized by mixing polysiloxane, such as polydimethylsiloxane having a sillanol end group, as a base polymer with polymethylhydrogen siloxane as a crosslinking agent and then conducting thermal condensation of the base polymer in the presence of organic acid metallic salts, such as an organotin catalyst, or amines; cure silicon resins synthesized by reaction of polydiorganosiloxane having a reactive functional end group, such as a hydroxyl group or an alkoxy group; or polysiloxane resins synthesized by condensation of sillanol obtained by hydrolysis of at least trifunctional chlorosilane alone or in combination with monofunctional or difunctional chlorosilane.

Further, the condensation curable silicone resins are classified into solution type and emulsion type, both of which can be very preferably used.

Among the thermosetting silicone resins, the examples of the addition curable silicone resins may include curable silicone resins synthesized by mixing polysiloxane, such as polydimethylsiloxane having a vinyl group, as a base polymer with polydimethylhydrogen siloxane as a crosslinking agent and then conducting a reaction of the base polymer and a curing in the presence of a platinum catalyst.

Further, the addition curable silicone resins are classified into solvent type, emulsion type, and non-solvent type, all of which can be very preferably used.

The examples of the thermosetting silicone resins obtained by condensation/addition curing may include pure silicone resins, silicone alkyd resins, silicone epoxy resins, silicone polyester resins, silicone acryl resins, silicone phenol resins, silicone urethane resins, silicone melamine resins, etc.; all of which can be very preferably used.

The examples of the light curing silicone resins may include curable silicone resins synthesized in the presence of an photo cationic catalyst, or curable silicone resins synthesized by using a radical curing mechanism. There may also be preferably used modified silicone resins obtained by a light curing reaction between a low molecular weight polysiloxane having a hydroxyl group or an alkoxide group bonded to a silicon atom and alkyd resin, polyester resin, epoxy resin, acryl resin, phenol resin, polyurethane resin, or melamine resin. These resins may be used alone or as a mixture of two or more.

(Bonding Layer)

The bonding layer is a layer disposed in order to strengthen the adhesion between the image receiving layer and the transparent support and prevent the transparent support from being peeled off of the image receiving support fabricated by using the transfer sheet. Thus, the bonding adhesive used for the bonding layer is preferably a bonding adhesive having good mutual affinity with, for example, the aforementioned materials used for the image receiving layer and the transparent support. In other words, the preferred bonding adhesive is a bonding adhesive that has a function of providing a firm bonding between the image receiving layer and the transparent support.

The examples of the bonding adhesive may include thermoplastic resins. Among the thermoplastic resins, polyester-based bonding adhesives using a polyester resin are preferred. The examples of the polyester resins may include, in addition to normal polyester resins, silicone-modified polyester resins, urethane-modified polyester resins, acryl-modified polyester resins, etc., which can be very preferably used. Further, in the polyester-based bonding adhesives, these polyester resins may be used alone or as a mixture of two or more.

In addition to the polyester-based bonding adhesives, the examples of the bonding adhesives may also include bonding adhesives using a homopolymer or a copolymer obtained by polymerizing at least any one or two of styrenes, such as styrene, vinylstyrene, chlorostyrene etc.; mono-olefins, such as ethylene, propylene, butylene isobutylene, etc.; vinylesters, such as vinyl acetate, vinyl propionate, vinyl benzoate, vinyl butyrate, etc; esters of α-unsaturated fatty acid monocarboxylate, such as methyl acrylate, ethyl acrylate, butyl acrylate, dodecyl acrylate, octyl acrylate, phenyl acrylate, methyl methacrylate ethyl methacrylate, butyl methacrylate, dodecyl methacrylate, etc.; vinyl ethers, such as vinyl methyl ether, vinyl ethyl ether, vinyl butyl ether, etc.; vinyl ketones, such as vinyl methyl ketone, vinyl hexyl ketone, vinyl isopropenyl ketone, etc.; or diene-based monomers, such as isoprene, 2-chlorobutadiene, etc.

Other bonding adhesives may include silicone-based bonding adhesives, urethane-based bonding adhesives, epoxy-based bonding adhesives, melamine-based bonding adhesives, urea-based bonding adhesives, rubber-based (chloroprene-, styrenebutadiene-, or nitrile-based) bonding adhesives, and so on.

In forming the bonding layer, the above-mentioned resins may be applied directly or after diluted with a solvent.

The examples of the solvent used to dilute the resins may include methyl ethyl ketone, toluene, xylene, cyclohexanone, solvesso, ethyl acetate, isophorone, propylene glycol monomethyl ether acetate, n-butyl cellosolve, t-butyl cellosolve, methanol, ethanol, propanol, butanol, etc., which may also be used as a mixture of two or more.

If not specifically limited, the thickness of the bonding layer is preferably in the range from 0.1 μm to 10 μm, more preferably from 1 μm to 5 μm.

(Substrate)

Hereinafter, a description will be given as to the substrate used in the exemplary embodiment of the present invention.

The representative example of the substrate may be, but not specifically limited to, plastic films. The preferred examples of the plastic films may include polyacetate films, cellulose triacetate films, nylon films, polyester films, polycarbonate polysulfone films, polystyrene films, polyphenylene sulfide films, polyphenylene ether films, cyclo-olefin films, polypropylene polyimide films, cellophane films, acrylonitrile-butadiene-styrene (ABS) resin films, etc. These plastic films may be white or opaque.

Furthermore, the films in the sheet form, such as of paper, metal, plastic, ceramic, or the like may also be preferably used.

(Adhesive Layer)

The transfer sheet according to the exemplary embodiment of the present invention may have an adhesive layer disposed between the transparent support and the substrate.

The term "adhesive layer" as used herein refers to a layer having an adhesive function of physically binding the transparent support and the substrate together until the step of transferring an image formed on the transfer sheet onto the image support, and a function of being removable from the transparent support in the step of transferring the image after lamination and cooling.

Further, the adhesive layer may be made of a material in the semisolid state (i.e., being viscosity) at the room temperature and room pressure (22° C., 50%), which material may be used to bind other layers together while having no change in the semisolid state and not rendering the adhesive layer solidified even after providing adhesion. The adhesive layer may also use a material in the solid state at the room temperature and room pressure (22° C., 50%).

The material for the adhesive layer may be rubber-based materials, including natural rubber, styrene-butadiene-rubber (SBR), butyl rubber, etc. The synthetic resin-based materials may include acryl-based resins, silicone-based resins, hot-melt resins, and so forth. In this regard, synthetic resin-based materials which are controllable in peeling strength by using an additive are preferred, and silicone-based resin materials are more preferred among the synthetic resin-based materials in terms of time-dependent stability or heat resistance. However, the materials for the adhesive layer are not specifically limited to those aforementioned, in regard to compatibility with the transparent support.

(Properties of Image Transfer Sheet)

Further, in the transfer sheet of the exemplary embodiment of the present invention, the surface resistivity of the image receiving layer disposed on the substrate is preferably in the range from $1.0\times10^{8}\Omega$ to $3.2\times10^{13}\Omega$, more preferably in the range from $1.0\times10^{9}\Omega$ to $1.0\times10^{12}\Omega$.

In the exemplary embodiment of the present invention, the surface resistivity difference between the top and bottom side surfaces of the transfer sheet at 23° C. and 55% RH is preferably four orders of magnitude or less, more preferably three orders of magnitude or less.

Further the surface resistivity is measured according to JIS K 6911 by using a circular electrode (for example, Highrester IP "HR probe" manufactured by Mitsubishi Petrochemical Co., Ltd.) under conditions of 23° C. and 55% RH.

In controlling the surface resistivity of the image receiving layer within the range from $1.0\times10^{8}\Omega$ to $3.2\times10^{13}\Omega$, the image receiving layer preferably contains a charge controlling agent. The examples of the charge controlling agent may include a polymer conductive agent, a surfactant, conductive metal oxide particles, and so forth.

Further, a matting agent is preferably added to the image receiving layer or coating layer other than the image receiving layer disposed on the surface of the substrate.

The examples of the conductive metal oxide particles may include ZnO, TiO, $TiO_2$, $SnO_2$, $Al_2O_3$, $In_2O_3$, SiO, $SiO_2$, MgO, BaO, $MoO_3$, and so on. These conductive metal oxide particles may be used alone or as a mixture of two or more. Preferably, the metal oxides may further contain hetero elements. It is preferable, for example, to use ZnO containing (or doped with) Al, In, etc., TiO containing (or doped with) Nb, Ta, etc.; and $SnO_2$ containing (or doped with) Sb, Nb, halogens, etc. Among these metal oxides, Sb-doped $SnO_2$ is particularly preferred, because it can have an insignificant time-dependent change in conductivity and high stability.

The examples of the resin having a lubricating action as used in the matting agent may include polyolefins, such as polyethylene; or fluorine resins, such as polyvinyl fluoride, polyvinylidine difluoride, polytetrafluoroethylene (Teflon®).

In the case where the image receiving layer is disposed on the one side of the substrate only, the surface resistivity of the substrate can be controlled by adding a surfactant, a polymer conductive agent, or conductive particles to the resin in the fabrication of a film to become a substrate; applying, a surfactant or depositing a metal thin film on the surface of the film; or adding an appropriate amount of a surfactant to the adhesive.

The examples of the surfactant as used herein may include cationic surfactants, such as polyamines, ammonium salts, sulfonium salts, phosphonium salts, betaine-based amphoteric salts, etc.; anionic surfactants, such as alkyl phosphate, etc.; or nonionic surfactants, such as fatty acid esters, etc. Among these surfactants, cationic surfactants which exert great interactions with the negatively charged toner recently used for electrophotographic printing are preferred as electrophotographic surfactants.

Further, among the cationic surfactants, quarternary ammonium salts are preferred. Preferably, the quarternary ammonium salts may be a compound represented by the following formula (I):

[Formula I]

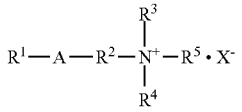

In the formula, $R^1$ is alkyl, alkenyl, or alkynyl having from 6 to 22 carbon atoms, and $R^2$ is alkyl, alkenyl, or alkynyl having, from 1 to 6 carbon atoms. Each of $R^3$, $R^4$, and $R^5$ may be the same or different from each other and include aliphatic groups, aromatic groups, or heterocyclic groups. The tem "aliphatic" as used herein refers to any linear, branched, or cyclic alkyl, alkenyl, or alkynyl group. The term "aromatic" as used herein refers to any benzene-derived monocyclic aryl group or condensed polycyclic aryl group. These groups may have any substituent such as a hydroxyl group. A is an amide bond, an ether bond, an ester bond, or a phenyl group, and may be omitted, $X^-$ is halogen, sulfate ion, or nitrate ion, which ions may have any substituent.

(Fabrication Method for Image Transfer Sheet)

Hereinafter, a description will be given as to a fabrication method for the image transfer sheet by exemplifying the image transfer sheet according to an exemplary embodiment of the present invention as illustrated in FIG. 1. The image transfer sheet according to an exemplary embodiment of the present invention as illustrated in FIG. 1 includes a substrate 110, an adhesive layer 120, a transparent support 130, a bonding layer 150, and an image receiving layer 140.

In the image transfer sheet according to the exemplary embodiment of the present invention, for example, a fixed image of the reversal image (mirror image) is formed on the surface of the substrate 110 having transparency so that the image on the image support after the image transfer process appears as an image of normal rotation (i.e., normal image).

In the fabrication method for the transfer sheet according to the exemplary embodiment of the present invention that has the adhesive layer 120, an adhesive to be the adhesive layer 120 is applied to the surface of the substrate 110, and the aforementioned films to form the transparent support 130 are adhered, after which a bonding adhesive to be the bonding layer 150 is further applied to the surface of the transparent support, and then a coating layer to be the image receiving layer 140 is applied to complete the transfer sheet.

In an alternative method, an adhesive to be the adhesive layer 120 is applied to the surface of the substrate 110, and a bonding adhesive to be the bonding layer 150 is applied to the surface of the above-described film to form the transparent support 130, followed by applying a coating layer to be the image receiving layer 140. Then, the side of the transparent support 130 opposite to the image receiving layer 140 is bound to the side of the adhesive layer 120 of the substrate 110, completing the transfer sheet.

Further, in formation of the bonding layer 150, a drying process may be carried out after application of the bonding adhesive. The drying method may include heat drying and air drying. More specifically, the drying method may employ any known drying method, such as in-oven drying, conveyor oven drying, or heated-roller drying.

The coating layer of the image receiving layer 140 can be formed by mixing individual ingredients, such as wax, resin, panicles, or the like, in an organic solvent or water, dispersing the mixture with such equipment as using ultrasound, wave rotors, attritors, or sand mills to prepare a coating liquid, and then applying the coating liquid directly to the surface of the bonding layer 150.

The coating or impregnation method may employ any known method, such as blade coating, wire bar coating, spray coating, dip coating, bead coating, air knife coating, curtain coating, roll coating, and so forth.

For the image transfer sheet that has, for example, a coating layer on both sides of the substrate 110, the coating may be applied to the one side of the substrate and then the other, or simultaneously applied to both sides of the substrate.

The drying process in forming the coating layer on the surface of the substrate 110 may employ air drying, but heat drying is an easy way to dry. The drying method may be a commonly used method, such as in-oven drying, conveyor oven drying, or heated-roller drying.

In the aspect of actual use, the coefficient of static friction on the surface of the transfer sheet is preferably 2 or less, more preferably 1 or less. Further, the coefficient of kinetic friction on the surface of the transfer sheet is preferably in the range from 0.2 to 1, more preferably in the range from 0.3 to 0.65.

In the exemplary embodiment of the present invention, for example, a toner image is formed as an image on the surface of the image transfer sheet. In ease of forming a toner image, fixing the toner image is preferably carried out so that the temperature on the surface (i.e., the image-formed side) of the image transfer sheet is equal to or lower than the melting temperature of the toner.

In consideration of the melting temperature of a typical toner, fixing is carried out while the temperature on the surface of the image transfer sheet is preferably 130° C. or below, more preferably 110° C. or below.

Although it is described in the exemplary embodiment of the present invention that the image formed on the surface of the image transfer sheet is a toner image thrilled by an electrophotographic image forming apparatus, it is not limited to the image specified in the description. For example, the image may be formed using an ink or the like.

The thickness of the image receiving layer 140 thus formed is preferably in the range from 5 μm to 25 μm, more preferably in the range from 7 μm to 20 μm.

(Thickness of Image Transfer Sheet)

The thickness of a card with a built-in data chip such as an IC chip is up to 840 μm as a given standard (for example, according to JIS X 6301: 2005). The thickness greater than the defined value is considered to be non-standard. The portion to be the core of the card with a built-in data chip such as an IC chip is already 760 μm thick. To transfer an image using, a laminate film on the surface of the core of the card, it is necessary to adjust the thickness of the transfer-receiving layer to 80 μm or less for single-sided transfer and 40 μm or less for both-sided transfer. But, the laminate film (i.e., transfer sheet) is needed to be fed through an image forming apparatus such as an electrophotographic image forming apparatus, so the thickness of the laminate film is preferably 75 μm at minimum in view of maintaining stiffness.

In this regard, the total thickness of the image receiving layer, the bonding layer, and the transparent support in the transfer sheet according to the exemplary embodiment of the present invention is preferably from 12 μm to 80 μm, and the total thickness of the whole transfer sheet is preferably from 75 μm to 135 μm.

In the transfer sheet in which the total thickness of the image receiving layer, the bonding layer, and the transparent support is defined to be 80 μm or less, the total thickness of the entity 75 μm or greater can maintain stiffness of the sheet passing through the image forming apparatus, while the total thickness of the entity 135 μm or less can maintain good transferability of the image forming material such as the toner and thus form an image of high quality. Further, the total thickness of the image receiving layer, the bonding layer, and the transparent support as defined to be 12 μm or greater can make it easier to form the image receiving layer without irregularity on the transparent support and facilitate maintenance in large area.

In this regard, the thickness of the individual layers stated in this specification is measured with a digimatic indicator (ID-H0530 manufactured by Mitutoyo Corp.

<Image Recording Material>

Hereinafter, a description will be given as to an image recording material fabricated using the image transfer sheet according to the exemplary embodiment of the present invention.

The method of forming an image on the surface of the image receiving layer of the transfer sheet according to the exemplary embodiment of the present invention may employ a known image forming method, such as a method to form an ink image using an ink, in addition to the electrophotographic image forming method to form a toner image.

The image recording material according to the exemplary embodiment of the present invention can be prepared by forming an image containing an image forming material in a mirror image on a side of the image transfer sheet, the side on which the image receiving layer disposed; laminating the image transfer sheet on an image support such so as to face a surface on which the image of the image transfer sheet is formed with one side of the image support, and transferring the image receiving layer, the bonding layer, and the transparent support of the image transfer sheet, and the image containing the image forming material onto the image support, by peeling the substrate of the image transfer sheet off the image support, wherein the image recording material includes the image support, the image receiving layer, the bonding layer, and the transparent support in this order, and the image containing the image thrilling material is provided in a region between the image support and the image receiving layer.

Further, the fabrication of the image recording material is achieved, for example, by a method at least including: an image forming process for forming an image made of an image forming material as a mirror image on the side of the above-described image transfer sheet on which the image receiving layer is formed; a positioning process for overlapping the image transfer sheet and the image support to make a laminate having the image-formed side of the image transfer sheet face the one side of the image support; a heat compression process thr compressing the positioned laminate by heat; and a peeling process for solidifying the image forming material by cooling, peeling at least the substrate of the image transfer sheet off of the image support, and transferring the image receiving layer, the bonding layer, and the transparent support of the transfer sheet and the image forming material onto the image support to record the image.

The examples of the image recording material may include (1) a construct of image sheets or image panels produced by transferring an image onto the image support by heat compression from the image transfer sheet of the exemplary embodiment of the present invention on the surface of which a toner image corresponding to data is formed; and (2) a construct of data recording media, including IC cards, magnetic stripe cards, optical cards, or IC/magnetic/optical cards, which can hold predetermined data and perform contact or non-contact communications with external equipment, where the data recording media at least includes a data chip at least containing data readable by at least one unit selected from an electrical unit, a magnetic unit, and an optical unit as arranged in at least one region of the image support.

In the image recording material as specified in (1), the toner image is not specifically limited as long, as it includes a toner image a part or the whole of which serves as certain identification information and functions as identifiable information such as image or character data. Further, the identification of the toner image as information is not specifically limited to visual identification and may also include mechanical identification.

In the image recording material (i.e., data recording media) as specified in (2), the data chip holds information having a certain identification function and may not be specifically limited as long as it is readable by at least one unit selected from an electrical unit, a magnetic unit, or an optical unit. The data chip may be a read-only chip, or a readable and writable (including "rewritable") chip as needed. Further, the examples of the data chip may include IC chips (i.e., semiconductor circuits).

When the data chip is used as a data source for the image recording material, it is not specifically limited whether part or the whole of the toner image holds information having a certain identification function.

On the other hand, the information contained in the toner image or the data chip is not specifically limited and may include variable information. The term "variable information" as used herein implies that different information is contained in each of the plural image recording materials produced according to the same specifications or standards.

For example, when including variable information, the toner image of the portion corresponding to the variable information may be a different toner image for each image recording material.

Furthermore, the variable information may include personal information. In this case, the image recording material (i.e., data recording medium) of the exemplary embodiment of the present invention is applicable to cash cards, employee ID cards, student ID cards, membership cards, residence cards, any type of driver's license cards, any type of certificate cards, and so forth. In the case of using the variable information for such a use purpose, the examples of the personal information may include the holder's photograph, image data for personal identification, name, address, date of birth, or a combination of two or more of these.

To form an image on the transfer sheet by electrophotography, formation of an electric charge is caused on the surface of a visual receptor (i.e., image carrier) for electrophotography, and the image information thus obtained on the surface of the visual receptor is then subjected to exposure to form an electrostatic latent image corresponding to the exposure. Subsequently, a toner as an image forming material is supplied front a developing machine to the electrostatic latent image on the surface of the visual receptor to visualize the electrostatic latent image with the toner (thereby forming a toner image). The toner image thus obtained is transferred onto the side of the transfer sheet on which the image receiving layer is formed. Finally, the transferred toner image is fixed on the surface of the image receiving layer by heat or pressure, and the transfer sheet exits the electrophotographic apparatus.

As the transfer sheet according to the exemplary embodiment of the present invention is laminated on the image support to have the image-formed side (i.e., the side on which the image receiving layer is disposed) face the image support including an IC chip or the like and thereby transfer the image, the image formed on the image receiving layer of the transfer sheet is needed to be a reversal image (i.e., mirror image), and the image data exposed on the surface of the visual receptor is thus preferably provided as information in the mirror image of the transferred image on the image receiving layer when the electrostatic latent image is formed on the surface of the visual receptor.

The image support used in the exemplary embodiment of the present invention is preferably made of metals, plastics, or ceramics, which are preferably provided in the form of sheets.

As for the image support used in the exemplary embodiment of the present invention, a plastic sheet is preferred. An opaque plastic sheet is particularly preferred to make the image easily seen when used for an image recording material. The representative example of the opaque plastic sheet is a whitened plastic sheet.

The resin for the plastic sheet may include those used for the substrate of the image transfer sheet. The examples of the plastic resin preferably include polyacetate films, cellulose triacetate films, nylon films, polyethylene terephthalate films, polyethylene naphthalate films, polycarbonate films, polystyrene films, polyphenylene sulfide films, polypropylene films, polyimide films, cellophane, acrylonitrile-butadiene-styrene (ABS) resin films, vinyl chloride sheets, acryl sheets, and so forth.

The more preferred resins are polyester films, which may particularly include so-called PETG derived from polyethylene terephthalate where about a half the ethylene glycol component is substituted with the 1,4-cyclohexane methanol component; an alloy of the polyethylene terephthalate mixed with polycarbonate, or amorphous polyester called "A-PET" as polyethylene terephthalate that is not biaxially stretched.

In the exemplary embodiment of the present invention, the side of the image support onto which at least the image is transferred preferably includes PETG.

In consideration of using the image support not including chlorine, the exemplary embodiment of the present invention may also use an additional material prepared by adding a hotmelt adhesive, such as of polyester or EVA, to the polystyrene-based resin sheet, the ABS resin sheet, the acrylonitrile-styrene (AS) resin sheet, or polyolefin-based resin sheets, such as of polyethylene terephthalate, polyethylene, or polypropylene.

The whitening method for plastic resins includes adding a white pigment, such as, for example, metal oxide particles, such as of silicon dioxide, titanium dioxide, calcium dioxide, etc. organic white pigments, or white organic particles into the film. Further, sandblasting or embossing is carried out to create a relief on the surface of the plastic sheet, so the scattering of light caused by the relief can make the plastic sheet whitened.

The image support used in the exemplary embodiment of the present invention is preferably a plastic sheet having a thickness ranging from 75 μm to 1,000 μm, more preferably a PETG sheet having a thickness from 100 μm to 750 μm.

In the exemplary embodiment of the present invention, a semiconductor circuit may be built in the image support or provided on the surface, in the case where the final image recording material is used as an IC card or the like.

The process of arranging a built-in semiconductor circuit in the image support preferably employs a general method of inserting a sheet, so-called "inlet sheet", with the semiconductor circuit fixed thereon between the sheet materials constituting the image support and then integrating it with the sheet materials by hot melting with a hot press. Also, the semiconductor circuit may be arranged without using the inlet sheet and then subjected to integration by hot melting.

Alternatively, the constituent sheets of the image support may be put together with an adhesive such as of hotmelt and then provided with a built-in semiconductor circuit, which is not given, to limit the present invention. For example, any method of providing a built-in semiconductor circuit in an IC cards is applicable to the fabrication method for the image support.

Furthermore, if there is no problem with the use as an image recording material, the semiconductor circuit may be arranged while it is exposed on the surface of the image support other than inside.

Further, when the image recording material of the exemplary embodiment of the present invention is used as a magnetic stripe card as well as an IC card, an antenna, a magnetic stripe, or an external terminal may be embedded in the image support as needed. Further, there are some cases that magnetic stripes or holograms are printed, or necessary character information is embossed on the image support.

The overlapping of the transfer sheet and the image support may be carried out by uniformly aligning the transfer sheet and the image support by bands, or by sequentially collecting the transfer sheet and the image support in a gathering section after formation of an image on the transfer sheet and then uniformly aligning them.

The compression method in the heat compression process is not specifically limited and may employ any one of known laminating techniques and laminating apparatuses, all of which can be very preferably used. Among these methods, a heat press method that involves lamination by heat is preferred. For example, a laminate of the transfer sheet and the image support may be compressed by any typical laminating technique or laminating apparatus which passes the laminate through the pressure contact section (i.e., nip member) of a pair of hot rolls to make both the transfer sheet and the image support hot-melted to some extent and fused together by heating.

After the laminate is heat-compressed, the image forming material is solidified by cooling, the substrate of the electrophotographic transfer sheet is peeled off of the image support, while the image funning material is transferred onto the image support to record an image, thereby completing the image recording material according to the exemplary embodiment of the present invention.

More specifically, the temperature for solidification by cooling is the vitrification temperature of the toner or below at which the toner becomes hard enough, that is, for example, the glass transition temperature of the image forming material or below, preferably from the morn temperature (i.e., 22° C.) to 50° C. Further, the condition for peeling the transfer sheet off of the image support is not specifically limited and preferably includes gripping the end of the transfer sheet by hand and slowly peeling it off of the image support.

Figure 2A:
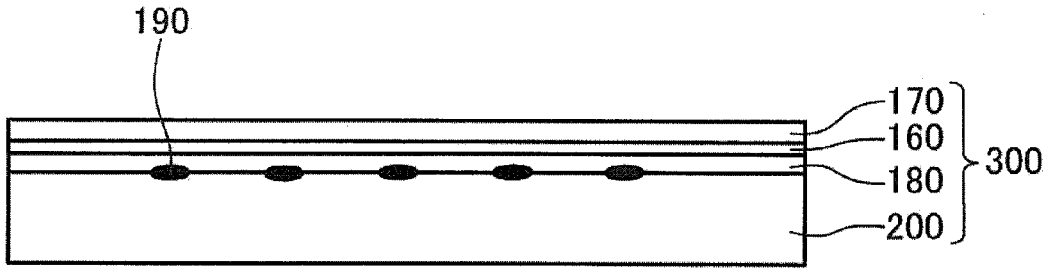
FIG. 2A is a cross-sectional view showing the condition of a laminate, that is, an image recording material, before heat compression according to an exemplary embodiment of the present invention.
Figure 2B:
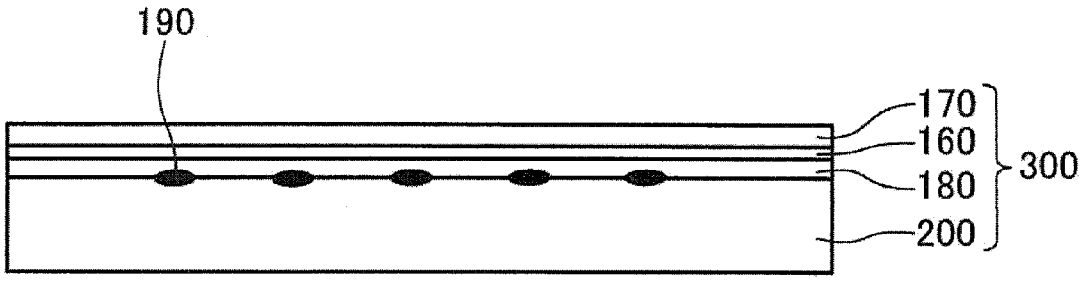
FIG. 2B is a cross-sectional view showing the condition of a laminate, that is, an image recording material, after heat compression and peeling according to an exemplary embodiment of the present invention.

Next, a description will be given as to a specific example of the above-described image recording material with reference to the accompanying drawings. FIGS. 2A and 2B presents cross-sectional views showing an example of the image recording material before heat compression and after heat compression and peeling procedures in the fabrication of the image recording material according to the exemplary embodiment of the present invention. In FIGS. 2A and 2B, reference number 100 denotes the transfer sheet, reference number 200 the image support, and reference number 300 the image recording material.

FIG. 2A shows a laminate constructed by laminating the transfer sheet 100 and the image support 200 (for example, PETG sheet) used as a transfer-receiving material. Before heat compression, an image forming material (i.e., toner) 190 exists in an image receiving layer 180 or in the interface between the image receiving layer 180 and the image support 200.

After heat compression, as shown in FIG. 2B, the image forming material 190 is completely embedded in the surface of the image support 200 and in the image receiving layer 180. Consequently, there is little step difference on the surface of the image support 200 and the portion containing the image forming material 190, so image recording material 300 thus completed has the same texture of the image recording material produced by direct printing, and the image forming material 190 does not easily peel off.

After the peeling process, a bonding layer 160 is disposed on the side of the image support 200, so the remaining transparent support 170 serves as an overcoat layer for the image recording material 300.

The image recording material 300 peeled apart may be directly used as the image recording material according to the exemplary embodiment of the present invention. However, in the case where a plurality of individual images are formed on an electrophotographic transfer sheet, the individual images are cut out to prepare a plurality of image recording materials in a given size.

Further, the examples of the image recording material according to the exemplary embodiment of the present invention may include any kind of data recording media containing contact/noncontact image data for personal information that include a photograph of the holder, such as cash cards, employee ID cards, student ID cards, residence cards, driver's license cards, certificate cards, etc., RFID tags, and furthermore, image recording materials used in medical sites or the like, such as image sheets for reference, image display panels, display labels, etc.

(Fabrication of Image Recording Material)

Figure 3:
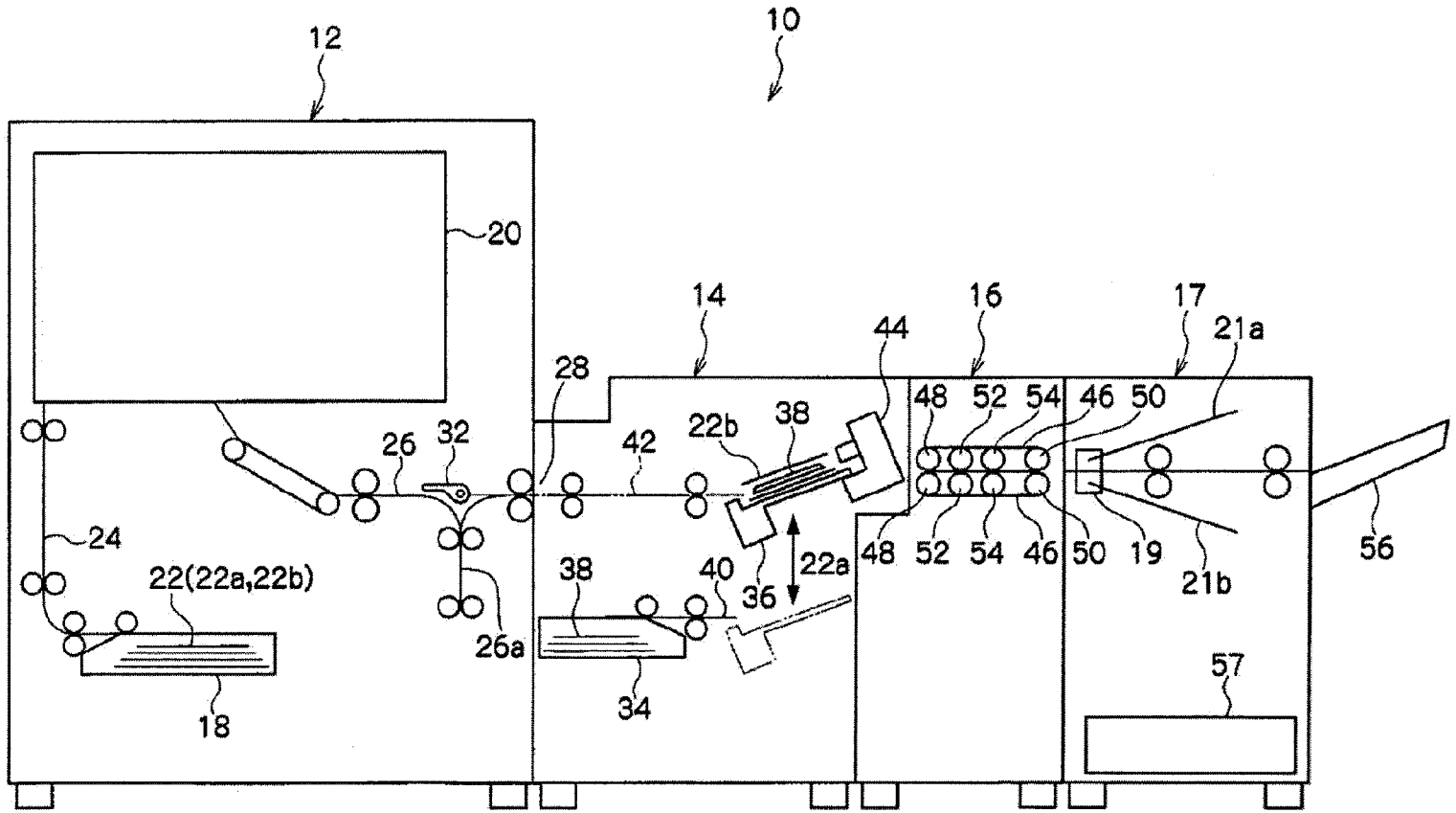
FIG. 3 is a schematic diagram showing a constructional example of an apparatus for fabricating the image recording material according to an exemplary embodiment of the present invention.

Hereinafter, a description will be given as to the fabrication method for the image recording material according to the exemplary embodiment of the present invention. FIG. 3 is a schematic diagram showing an apparatus for fabricating the image recording material according to the exemplary embodiment of the present invention.

Apparatus 10 for fabricating the image recording material as shown in FIG. 3 includes an image forming apparatus 12, a gathering apparatus (i.e., positioning section) 14, a laminating apparatus (i.e., heat compression section) 16, and a peeling apparatus (i.e. peeling section) 17.

The image forming apparatus 12 may include, for example, a transfer sheet receiving section 18, an image forming section 20, a conveyor route 24 for conveying a transfer sheet 22 from the transfer sheet receiving section 18 to the image forming section 20, and a conveyor route 26 for conveying the transfer sheet 22 from the image forming section 20 to an outlet 28. The other components other than those listed above are omitted in the description.

The transfer sheet receiving section 18 not only receives the transfer sheet 22 but conveys the received transfer sheet 22 to the image forming section 20 by using pickup rolls or feeding rolls, which are provided in a typical feeding apparatus and designed to rotate with a given timing.

The image forming section 20 may be constructed with a known electrophotographic apparatus (not shown) that includes a latent image holding carrier, a charger for electrically charging the latent image holding carrier, a latent image thrilling apparatus for forming a latent image on the charged latent image holding carrier, a developer for developing the latent image with a developing agent including at least a toner to form a toner image, a transferring unit for transferring the developed toner image onto the transfer sheet 22, and a fixing unit for fixing the toner image transferred on the transfer sheet 22 by heat and pressure.

The conveyor routes 24 and 26 consist of a plurality of roller pairs including pairs of driving rollers or guides (not shown). Moreover, the conveyor route 26 is provided with a turnover route 26*a* to reverse the conveying direction of the transfer sheet 22 by 180 degrees. In a branch-off section to the conveyor route 26 and the turnover route 26*a*, a cam 32 is provided to change the guiding direction for the transfer sheet 22 so that the transfer sheet 22 is guided to have round trip to the turnover route 26*a* and return to the conveyor route 26. As a result, the transfer sheet 22 is conveyed in the 180-degree reversed direction while the top and bottom side surfaces are reversed.

The gathering apparatus 14 includes a plastic sheet (i.e., image support) receiving section 34, a gathering section (i.e., positioning section) 36, a conveyor route 40 for feeding a plastic sheet (i.e., image support) 38 from the plastic sheet receiving section 34 to the gathering section 36, and a conveyor route 42 for feeding the transfer sheet 22 output from the outlet 28 of the image forming apparatus 12 to the gathering section 36.

An outlet section of the conveyor route 40 for feeding the plastic sheet 38 to the gathering section 36 and an outlet section of the conveyor route 42 for feeding, the transfer sheet 22 to the gathering section 36 are arranged in parallel in a height-wise direction.

The conveyor routes 40 and 42 may consist of a plate-shaped member of which the surface is provided with a conveyor roll for conveying the transfer sheet 22 or the plastic sheet 38, or a rotating belt type conveyor material. At the timing of the transfer sheet 22 or the plastic sheet 38 coming out of the image forming apparatus 12, the conveyor roll or belt is rotated to convey the transfer sheet 22 or the plastic sheet 38 to the gathering section 36.

The plastic sheet receiving section (i.e., image support receiving section) 34 receives the plastic sheet and has pickup rolls or feeding rolls as provided in a typical feeding apparatus, so the feeding rolls or the like rotate to convey the plastic sheet 38 to the gathering section when the gathering section 36 moves to the position of the outlet of the plastic sheet receiving section 34.

To receive the plastic sheet 38 and the transfer sheet 22 from the outlet sections of the conveyor routes 40 and 42, respectively, the gathering section 36 is connected to the outer wall of which part of the end is supported at the top and bottom (top and bottom as shown in the figure), so the gathering section 36 goes up and down according to the rotary drive of the belt. The elevator unit of the gathering section 36 is not specifically limited to this type of elevator unit and may employ any known elevator unit such as a motor-driven elevator system. Further, a positioning unit (not shown) is also provided to uniformly align the ends of the plastic sheet 38 and the transfer sheet 22 laminated.

The gathering section is provided with a temporary fixing apparatus 44 for temporarily fixing a laminate of two transfer sheets 22 with the plastic sheet 38 sandwiched between. The temporary fixing apparatus consists of, for example, a pair of projections made of metal to be heated by a heater or the like so that the end of the laminate is put between the heated projection pair and thus temporarily fixed through heat welding.

The temporary fixing method is not specifically limited to the method using a pair of projections, as long as it uses heat welding, and it may include other conventional methods, such as passing a heated needle-shaped member in the perpendicular direction to the sheet, or nipping the sheet with a member provided with an ultrasound transducer to achieve welding by heat generated from ultrasound vibrations. Alternatively, the temporary fixing method may use a unit for mechanically restraining mutual movements rather than by using heat, that is, fixing with staples or using a gripper movable along with the sheet through the conveyor route.

In the case where the temporary fixing apparatus 44 is provided on the conveyor route of the laminate from the gathering section 36 to the laminating apparatus 16, the temporary fixing apparatus 44 is needed to have such a structure that it can be arranged at the end of the gathering section 36 during the temporary fixing period only but deviate from the conveyor route out of the temporary fixing period.

The laminating apparatus 16 may employ, for example, a belt nip system consisting of a pair of belts 46. Each belt 46 has a hot and pressure roll 48, and additional pressure rolls 52 and 54 supported by a support roll 50.

The compression method for the laminating apparatus 16 is not specifically limited and may include any known laminating techniques and laminating apparatuses, all of which can be very preferably used. For example, the laminate is inserted in the nip section through the hot roll pairs or the like and then compressed by a typical laminating technique and laminating apparatus, or a typical hot pressing technique and hot pressing apparatus, for heat-welding of both sheets by hot melting.

The peeling apparatus 17 consists of for example, an air jet nozzle 19 and guides 21*a* and 21*b* and is provided with an output tray 56 for the plastic sheet as arranged in the downstream side of the conveyor route of the plastic sheet.

Subsequently, a description will be given as to the operation of a recording apparatus 10 of the image recording material.

Firstly, in the image forming apparatus 12, a first transfer sheet 22*a* to be laminated on the bottom side surface (shown in the bottom side of the figure) of the plastic sheet 38 in the transfer sheet 22 is fed into the image forming section 20 from the transfer sheet receiving section 18 through the conveyor route 24, and a toner image is transferred onto the surface (shown in the top side of the figure) of the lint transfer sheet 22*a* by electrophotography and then fixed to form a fixed image (in the image forming process). As long as the fixed image is formed on the surface of the first transfer sheet 22*a*, the first transfer sheet 224 is conveyed to the outlet 28 directly through the conveyor route 26 and sent to the gathering apparatus 14.

In the gathering apparatus 14, the first transfer sheet 22*a* is fed into the gathering section 36 through the conveyor route 42 of the gathering apparatus 14, in this regard, the first transfer sheet 22*a* coming out of the outlet section of the conveyor route 42 is fed into the gathering section 36 by its self-load to have the image side face upwards.

Subsequently, the gathering section 36 is moved up/down to the outlet section of the conveyor route 40, and the plastic sheet 38 is fed into the gathering section 36 from the plastic sheet receiving section 34 through the conveyor route 40. In this regard, the plastic sheet 38 coming out of the outlet section of the conveyor route 40 is fed into the gathering section 36 by its self-load and laid over the first transfer sheet 22*a*.

Subsequently, in the image forming apparatus 12, a second transfer sheet 22*b* to be laminated on the top side surface (shown in the top side of the figure) of the plastic sheet 38 in the transfer sheet 22 is fed into the image forming section 20 from the transfer sheet receiving section 18 through the conveyor route 24, and a toner image is transferred onto the surface (shown in the top side of the figure) of the second transfer sheet 22*b* by electrophotography and then fixed to form a fixed image (in the image forming process). As long as the fixed image is formed on the top side of the second transfer sheet 22*b*, the second transfer sheet 22*b* moves along the conveyor route 26, returns to the conveyor route 26 via the turnover route 26*a*, and goes to the gathering apparatus 14.

In this regard, the cam 32 provided in the branch-off section to the conveyor route 26 and the turnover route 26*a* is driven to have its nose in connection to the conveyor route 26, so the second transfer sheet 22*b* arriving at the noise of the cam 32 is changed in the conveying direction and guided to the turnover route 26*a*. Once the second transfer sheet 22*b* arrives at the turnover route 26*a*, a driving roll (not shown) is reversed such that the second transfer sheet 22*b* makes a round trip to the turnover route 26*a* and returns to the conveyor route 26. Thus, the second transfer sheet 22*b* sent back to the conveyor route 26 is conveyed in the 180-degree reversed direction, while the top and bottom side surfaces are reversed, consequently with the image side facing downwards (shown in the bottom side of the figure).

In the gathering apparatus 14, the second transfer sheet 22*b* is fed into the gathering section 36 through the turnover route 42 of the gathering apparatus 14. In this regard, the second transfer sheet 22*b* coming out of the outlet section of the turnover route 42 is fed into the gathering section 36 by its self-load to have the image side face downwards and then laid over the plastic sheet 38.

In this manner, the first transfer sheet 22*a* with the image side facing upwards, the plastic sheet 38, and the second transfer sheet 22*h* with the image side facing downwards are fed into the gathering section 36 in such a sequential order and simultaneously laid one on the top of the other (in the positioning process). The laminate thus obtained has the plastic sheet 38 sandwiched between the first and second transfer sheets 22*a* and 22*b* of which the respective image sides face each other.

Subsequently, the ends of the first transfer sheet 22*a*, the plastic sheet 38, and the second transfer sheet 22*b* on the gathering section 36 are uniformly aligned by using a positioning unit (not shown) and temporarily fixed with the temporary fixing apparatus 44, after which the laminate is sent to the laminating apparatus 16. Further, the transfer sheet 22 and the plastic sheet 38 are cut out in the same size with the ends of the laminate uniformly aligned to conduct a positioning.

Subsequently, in the laminating apparatus 16, the laminate of the first transfer sheet 22*a*, the plastic sheet 38, and the second transfer sheet 22*b* is passed between the nips of a pair of belts 46 and subjected to heat compression, thereby pressing the plastic sheet 38 by heat between the first and second transfer sheets 22*a* and 22*b* (in the heat compression process).

The heat-compressed laminate is then conveyed to the peeling apparatus 17.

As the front end of the laminate approaches the air jet nozzle 19, a compressed air is jetted from the nozzle. This renders the end members of the substrates for the first and second transfer sheets 22*a* and 22*b* suspended above from the compressed plastic sheet 38 having the image receiving layer, the bonding layer, and the transparent support pressed on, and the front ends of the guides 21*a* and 21*b* enter the region between the substrate of the first transfer sheet 22*a* and the transparent support and the region between the substrate of the second transfer sheet 22*b* and the transparent support. Further, as the laminate is conveyed, the substrates of the two transfer sheets are conveyed apart farther from the plastic sheet 38 along the guides 21*a* and 21*b* and thus peeled off of the plastic sheet 38.

The plastic sheet 38 with the image receiving layer, the bonding layer, and the transparent layer pressed on is discharged to the output tray 56, so the completely recorded plastic sheet is produced. In this regard, when a plurality of individual images are formed on the plastic sheet, the plastic sheet is cut out for every image and provided in a given size.

The individual substrates of the first and second transfer sheets 22*a* and 22*b* are then discharged to a transfer sheet output tray 57 through a route (not shown).

As described above, the apparatus for fabricating the image recording material according to the exemplary embodiment of the present invention forms an electrophotographic image on the one side of two transfer sheets 22, disposes the plastic sheet 38 sandwiched between the two transfer sheets 22 while the image sides face each other, conducts heat compression on the laminate, and then peels off the substrates of the transfer sheets to obtain an image recording material.

Further, the turnover route 26*a* is provided in the course of the conveyor route 26 for conveying the transfer sheet 22 from the image forming section 20 in the image forming apparatus 12 to the outlet 28, so the first transfer sheet 22*a* fed into the bottom side on the gathering section 36 among the transfer sheets 22 does not go via the turnover route 26*a*, while the second transfer sheet 22*b* fed into the top side on the gathering section 36 is passed through the turnover route 26*a* and conveyed with its top and bottom side surfaces reversed. In this manner, the top and bottom side surfaces of the transfer sheet 22 are selectively reversed to conduct a continuous positioning, thereby achieving an efficient printing on the plastic sheet.

EXAMPLES

Hereinafter, the present invention will be described more specifically with reference to the examples, which are not intended to limit the present invention. The terms "part" and "%" in the following examples and comparative example mean "part by weight" and "wt %", respectively.

Example 1

The electrophotographic image transfer sheet (i.e., transfer sheet 1) is fabricated by the following method. Hereinafter, the fabrication method will be described by the respective processes.

<Preparation of Resistance Control Layer Liquid Aa-1>

0.5 part of spherical particles of crosslinked poly(methyl methacrylate) (SSX-102 manufactured by Sekisui Plastics Co., Ltd., average particle diameter 2 μm) as a filler and 200 parts of ethanol are mixed with 100 parts of an acryl-based polymer solution (Elecond QO-101 manufactured by Soken Chemical & Engineering Co., Ltd., solid concentration 50%) used as a cationic antistatic agent under sufficient agitation, to prepare a resistance control layer liquid Aa-1 that is to control the surface resistivity.

<Preparation of Image Receiving Layer Coating Liquid Ba-1>

20 parts of a polyester resin (Vylon 885 manufactured by Toyobo Co., Ltd.) as a thermoplastic resin, 1 part of a surfactant (Elegan 264 WAX manufactured by NOF Corp.), and 3 parts of spherical particles of crosslinked poly(methyl methacrylate) (SSX-115 manufactured by Sekisui Plastics Co., Ltd., average particle diameter 15 μm) as a filler are added to 50 parts of methyl ethyl ketone used as a solvent under sufficient agitation, to prepare an image receiving layer coating liquid Ba-1.

<Preparation of Bonding Layer Coating Liquid Ca-1>

30 parts of a polyester resin (Vylon 55SS manufactured by Toyobo Co., Ltd., solid concentration 35%) is diluted with 70 parts of methyl ethyl ketone under sufficient agitation to prepare a bonding layer coating liquid Ca-1.

<Preparation of Adhesive Layer Coating Liquid Da-1>

20 parts of a silicone adhesive (XR37-B9204 manufactured by GE Toshiba Silicones Co., Ltd., solid concentration 60%) and 0.2 part of a crosslinking agent (XC93-B6144 manufactured by GE Toshiba Silicones Co. Ltd.) are diluted with 20 parts of toluene under sufficient agitation to prepare an adhesive layer coating liquid Da-1.

<Fabrication of Transfer Sheet a1)

The adhesive layer coating liquid Da-1 is applied on the one side of a biaxially stretched PET (Rumilar 510 manufactured by Toray Industries, Inc., 75 μm thick) used as a substrate by wire bar coating and then dried out at 120° C. for 2 minutes to form an adhesive layer with a thickness of 5 μm.

The adhesive side of the substrate with the adhesive layer formed on is laminated on the one side of a biaxially stretched PET (Rumilar F53 manufactured by Toray Industries, Inc., 6 μm thick) used as a transparent support at the room temperature (22° C.), a laminating rate of 0.2 m/min, and a cylinder pressure of 588 Kpa.

The resistance control layer liquid Aa-1 is applied on the untreated side of the substrate of the laminated sheet by wire bar coating and then dried out at 120° C. for one minute to form a resistance control layer with a thickness of 0.5 μm.

Subsequently, the bonding layer coating liquid Ca-1 is applied on the untreated side of the transparent support of the laminated sheet by wire bar coating and then dried out at 120° C. for one minute to form a bonding layer with a thickness of 2 μm.

The image receiving layer coating liquid Ba-1 is applied on the bonding layer by wire bar coating and then dried out at 120° C. for one minute to form am image receiving layer with a thickness of 10 μm. The laminate is cut into a transfer sheet a1 in A4 size (210 mm×297 mm) with the total thickness of 98.5 μm.

(Performance Evaluation of Transfer Sheet)

—Measurement of Peeling Strength—

Here, the procedures are performed as follows to measure the interlaminar peeling strength in the transfer sheet a1.

The transfer sheet a1 is laminated on a 560 mm-thickness white PETG sheet (DIAFIX PG-WHI manufactured by Mitsubishi Rayon Co., Ltd.) used as an image support by using an apparatus for fabricating the aforementioned image recording material under the defined conditions, such as at temperature of 140° C., applied pressure of 1 kN, transfer speed of 0.4 m/min, and the resultant laminate is cooled down to 22° C.

Subsequently, the laminate with the transfer sheet at is cut into a sample 25 mm wide. The respective ends of the outermost layers on both sides of the sample (i.e., the image support (white PETG sheet) and the substrate (biaxially stretched PET)) are pulled out to peel off. A peeling occurs in the interface between "the transparent support and the adhesive layer" that is easiest to peel apart out of the adhered interfaces. The sample is peeled apart 6 mm in this interface. Both ends of the sample peeled apart are loaded into opposing tensile grips (e.g., chucks or clamps) of a tensile test machine, and the grips are separated at a constant rate of speed, 300 mm/min, to measure the 180 degree peeling strength (N/cm), which measurement is carried out according to the JIS-X6305.

Out of the two sample pieces completely peeled apart between the transparent support and the adhesive layer, the sample piece having the transparent support (biaxially stretched PET), the bonding layer, the image receiving layer, and the image support (white PETG sheet) is taken to pull out the respective ends of the outermost layers on its both sides (i.e., the image support (white PETG sheet) and the transparent support (biaxially stretched PET)). As a result, peeling occurs in the interface between "the image receiving layer and the image support (white PETG sheet)". With the interface peeled apart 6 mm, both ends of the sample piece peeled apart are loaded into opposing tensile grips (e.g., chucks or clamps) of a tensile test machine, and the grips are separated at a constant rate of speed, 300 mm/min, to measure the 180 degree peeling strength (N/cm), which measurement is carried out according to the JIS-X6305. JIS-X6305 defines that each layer constituting a card structure must be laminated so as to have peeling strength at interfaces between the each layer of 6 N/cm or more.

The respective interfaces between the substrate and the adhesive layer, between the transparent support and the bonding layer, and between the bonding layer and the image receiving layer are hard to separate/peel apart mechanically, so the peeling strength is considered greater in the difficult-to-peel interfaces than in the interface which is peeled apart and thus measurable in regard to peeling strength.

The measurement results are presented in Table 1.

Table 1 also presents the measurement results of the peeling strength in each interface of the transfer sheets fabricated in the following examples 2 to 6 and comparative example 1. As clearly shown, peeling strength at interface between image receiving layer and transparent support of Comparative example 1 does not meet the requirement of JIS-X6305.

TABLE 1

| | Peeling Strength [N/cm] | | |
|---|---|---|---|
| | Interface between transparent support and adhesive layer | Interface between image support and image receiving layer | Interface between image receiving layer and transparent support |
| Example 1 | 0.02 | 25 | — |
| Example 2 | 0.02 | 45 | — |
| Example 3 | 0.02 | 45 | — |
| Example 4 | 0.04 | 30 | — |
| Example 5 | 0.04 | 30 | — |
| Example 6 | 0.03 | 20 | — |
| Comparative Example 1 | 0.02 | — | 5 |

Color mirror images each including the holder's photograph, name, or beta image as a design are formed in the size (85.6 mm×54 mm) of the card on the surface of the image receiving layer of the transfer sheet (plain) a1 by using a color copier (DocuColor1257GA manufactured by Fuji Xerox Co., Ltd.), where totally 9 copies of the color mirror image are arranged at equal intervals in an array of images for 3 cards crosswise and images for 3 cards lengthwise.

—Evaluation of Conveyability in Apparatus—

To evaluate the conveyability (i.e., the running ability during conveying) of the fabricated transfer sheet a1 in the image forming apparatus, 30 of the transfer sheets a1 are loaded in a manual feeder of the image forming apparatus to obtain 30 prints by continuous printing and determine whether there occurs a stop of conveying (i.e., jam) caused by the sheet in the apparatus. The results are evaluated as follows:

A: No jam.

C: Jam occurs.

—Evaluation of Image Fixability—

The image fixability is evaluated according to whether the toner as an image forming material is peeled off by rubbing the image portion formed on the transfer sheet a1 with an eraser (MONO Eraser manufactured by Tombow Pencil Co., Ltd.). The results are evaluated as follows:

A: The toner does not peel off.

C: Even a little toner peels off.

—Evaluation of Image Quality—

To evaluate the quality of the image formed on the transfer sheet a1, a visual evaluation is carried out to detect image defects (e.g., image collapse and image deletion). The results are evaluated as follows:

A: No image defect.

C: Even a little image defect is observed.

(Fabrication of Image Recording Material (Card) a1)

A 250 μm thick white PET sheet is laminated on an A4-sized inlet sheet of polyethylene terephthalate (PET) film on which IC chips and antennas are formed at equal intervals in an array of images for 9 cards in total, that is, images for 3 cards crosswise and images for 3 cards lengthwise, to prepare a white card sheet with the total thickness of 760 μm. The transfer sheet a1 is laminated on both sides of the white card sheet under the defined conditions, such as temperature of 140 C, applied pressure of 1 kN, and transfer speed of 0.4 m/min. The laminate with, the transfer sheet a1 laid on both sides is cooled down to the room temperature (22° C.), and the transfer sheet a1 on either side of the laminate is removed of the substrate from the portion of the adhesive layer by peeling to obtain an image recording material a1 having its surface covered with the PET film on the white sheet and including the holder's photograph.

—Punching of Card—

Each portion of the image recording material a1 with an image that corresponds to the card design is punched out by using a card puncher (SP-N type manufactured by ISEL Co., Ltd.) to manufacture a card a1.

(Evaluation of Image Recording Material (Card))

The card a1 is evaluated in regard to the following properties.

—Evaluation of Image Concentration—

To evaluate the image concentration of the image formed on the image recording material a1 the beta image portion is measured in regard to the image concentration with an X-Rite 967 densitometer (manufactured by X-Rite Inc.). The results are evaluated as follows:

A: The image concentration is 1.5 or greater.

B: The image concentration is 1.3 or greater and less than 1.5.

C: The image concentration is less than 1.3.

—Evaluation of Surface Friction and Wear Resistance of Card—

On the assumption that the fabricated card a1 is used as a magnetic stripe card, it is swiped through a card reader (MR321/PS manufactured by Elite Co., Ltd.) 500 times continuously to detect surface flaws and wear condition through visual examination. The results are evaluated as follows:

A: No change.

B: A little flaw.

C: Some noticeable flaws.

D: The image receiving layer peels off to adversely affect the image.

The evaluation results are presented in Table 2.

—Evaluation of Surface Resistance to Solvent of Card—

On the assumption that a nail remover (i.e., polish remover) sticks to the fabricated card a1, the surface of the card is rubbed with a cotton swab soaked with acetone, ethyl acetate, or toluene to detect surface dissolution or flaws through visual examination. The results are evaluated as follows:

A: No change.

B: A little flaw.

C: Some noticeable flaws.

D: The imam receiving layer peels off to adversely affect the image.

The evaluation results are presented in Table 2.

—Evaluation of Adhesion—

A cutter is used to cut 1 mm wide nicks vertically and horizontally in the image portion transferred onto the surface of the card a1 to create a 25-squared grid pattern. A 19 mm wide polyester adhesive tape (No. 31B manufactured by Nitto Denko Corp., adhesive strength 5.6N/19 mm) is applied to the surface of the card a1 and pulled off to carry out a cross-cut tape test and evaluate the strippability of the image and the film (i.e., transparent support). In addition, the same test is conducted using a 19 mm wide polyester adhesive tape (No. 315 manufactured by Nitto Denko Corp., adhesive strength 12N/19 mm).

The results are evaluated as follows:

A: No peeling (at nick cross points and every square).

B: Slight peeling occurs at nick cross points but not in every square, and the deficient portion takes 5% or less of the total area of all squares.

C: Peeling occurs on both sides of the nicks and at the nick cross points, and the deficient portion takes more than 5% and 10% or less of the total area of all squares.

D: Peeling occurs on both sides of the nicks and at the nick cross points, and the deficient portion, takes more than 10% of the total area of all squares.

The evaluation results are presented in Table 2.

Example 2

Preparation of Image Receiving Layer Coating Liquid Ba-2

20 parts of a polyester resin (Vylon 200 manufactured by Toyobo Co., Ltd.) as a thermoplastic resin, 0.8 part of a surfactant (Elegan 264 WAX manufactured by NOF Corp.), and 4 parts of spherical particles of crosslinked poly(methyl methacrylate) (SSX-120 manufactured by Sekisui Plastics Co., Ltd., average particle diameter 20 μm) as a filler are added to 50 parts of methyl ethyl ketone used as a solvent under sufficient agitation, to prepare an image receiving layer coating liquid Ba-2.

<Preparation of Bonding Layer Coating Liquid Ca-2>

3 parts of a polyester urethane resin (Vylon 1350 manufactured by Toyobo Co., Ltd., solid concentration 33%) is diluted with 70 parts of methyl ethyl ketone under sufficient agitation to prepare a bonding layer coating liquid Ca-2.

<Fabrication of Transfer Sheet a2 and Image Recording Material (Card) a2>

The procedures are performed in the same manner as described in Example 1, excepting that the bonding layer coating liquid Ca-2 rather than the bonding layer coating liquid Ca-1 is used to form a bonding layer and the image receiving layer coating liquid Ba-2 rather than the image receiving layer coating liquid Ba-1 is applied to the top surface of the bonding layer to form a 15 μm thick image receiving layer, thereby fabricating a transfer sheet a2 and an image recording material (card) a2, which are then evaluated in the same manner as described in Example 1. The evaluation results are presented in Table 2.

Example 3

Fabrication of Transfer Sheet a3 and Image Recording Material (Card) a3

The procedures are performed in the same manner as described in Example 2, excepting that a polyphenylene sulfide film (Torelina manufactured by Toray Resin Company, 9 μm thick) is used in place of the biaxially stretched PET as the transparent support to fabricate a transfer sheet a3 and an image recording material (card) a3, which are then evaluated in the same manner as described in Example 1. The evaluation results are presented in Table 2.

Example 4

Preparation of Image Receiving Layer Coating Liquid Ba-4

20 parts of a polyester resin (Vylon GK640 manufactured by Toyobo Co., Ltd.) as a thermoplastic resin, 1 part of a surfactant (Elegan 264 WAX manufactured by NOF Corp.), and 3.5 parts of spherical particles of crosslinked acryl (MX-1500 manufactured by Soken Chemicals Co., Ltd., average particle diameter 15 μm) as a filler are added to 50 parts of methyl ethyl ketone used as a solvent under sufficient agitation, to prepare an image receiving layer coating liquid Ba-4.

<Preparation of Bonding Layer Coating Liquid Ca-4>

A polyester resin (Vylonal MD-1245 manufactured by Toyobo Co., Ltd., solid concentration 30%) is prepared as a bonding layer coating liquid Ca-4.

<Fabrication of Transfer Sheet a4 and Image Recording Material (Card) a4>

The procedures are performed in the same manner as described in Example 1, excepting that a biaxially stretched PET (F53 manufacture by Toray Industries, Inc., 75 μm thick) as a transparent support is laminated on a substrate (Panaprotect® ST manufactured by Panac) having a 7 μm thick adhesive layer formed on a 75 μm thick polyester (PET) film substrate; the resistance control liquid Aa-1 is applied to the untreated surface of the substrate; the bonding layer coating liquid Ca-4 is applied to the surface of the transparent support (biaxially stretched PET) to form a 2 μm thick bonding layer; and the image receiving layer coating liquid Ba-4 is applied to the bonding layer to form a 11 μm thick image receiving layer, thereby completing a transfer sheet a4 and an image recording material (card) a4, which are then evaluated in the same manner as described in Example 1. The evaluation results are presented in Table 2.

Example 5

Fabrication of Transfer Sheet a5 and Image Recording Material (Card) a5

The procedures are performed in the same manner as described in Example 4, excepting that a polyphenylene naphthalate film (Teonex Q51 manufactured by Teijin Dupont Films; thickness 12 μm) is used in place of the biaxially stretched PET as the transparent support to fabricate a transfer sheet a4 and an image recording material (card) a4, which are then evaluated in the same manner as described in Example 1. The evaluation results are presented in Table 2.

Example 6

Preparation of Image Receiving Layer Coating Liquid Ba-6

10 parts of a polyester resin (Vylon GK880 manufactured by Toyobo Co., Ltd.) and 33 parts of a polyester urethane resin (Vylon UR8200 manufactured by Toyobo Co., Ltd., solid concentration 30%) as thermoplastic resins, 1.5 part of a surfactant (Elegan 264 WAX manufactured by NOF Corp.), and 4.5 parts of spherical particles of crosslinked acryl (MX-3000 manufactured by Soken Chemicals Co., Ltd., average particle diameter 30 μm) as a filler are added to 10 parts of methyl ethyl ketone used as a solvent under sufficient agitation, to prepare an image receiving layer coating liquid Ba-6.

<Preparation of Bonding Layer Coating Liquid Ca-6>

30 parts of a polyester resin (Vylon UR3200 manufactured by Toyobo Co., Ltd., solid concentration 30%) is diluted with 70 parts of methyl ethyl ketone under sufficient agitation to prepare a bonding layer coating liquid Ca-6.

<Fabrication of Transfer Sheet a6 and Image Recording Material (Card) a6>

The procedures are performed in the same manner as described in Example 1, excepting that a biaxially stretched PET (F53 manufacture by Toray Industries, Inc., 6 μm thick) as a transparent support is laminated on a substrate (Panaprotect® MV manufactured by Panac) having a 10 μm thick adhesive layer formed on a 7.5 μm thick polyester (PET) film substrate; the resistance control liquid Aa-1 is applied to the untreated surface of the substrate; the bonding layer coating liquid Ca-6 is applied to the surface of the transparent support (biaxially stretched PET) to form a 20 μm thick bonding layer; and the image receiving layer coating liquid Ba-6 is applied to the bonding layer to form a 20 μm thick image receiving layer, thereby completing a transfer sheet a6 and an image recording material (card) a6, which are then evaluated, in the same manner as described in Example 1. The evaluation results are presented in Table 2.

Comparative Example 1

Fabrication of Transfer Sheet b1 and Image Recording Material (Card) b1

The procedures are performed in the same manner as described in Example 1, excepting that the image receiving layer is thrilled right on the transparent support without forming the adhesive layer, to fabricate a transfer sheet b1 and an image recording material (card) b1.

In the same manner as described in Example 1, the respective ends of the image support (white PETG sheet) and the substrate (biaxially stretched PET) of the transfer sheet b1 are pulled out to peel off. A peeling occurs in the interface between "the transparent support and the adhesive layer" that is easiest to peel apart out of the adhered interfaces. With the sample peeled apart 6 mm in this interface, the peeling strength (N/cm) is measured in the same manner as described in Example 1.

Out of the two sample pieces completely peeled apart between the transparent support and the adhesive layer, the sample piece having the transparent support (biaxially stretched PET), the image receiving layer, and the image support (white PETG sheet) is taken to pull out the respective ends of the image support (white PETG sheet) and the transparent support (biaxially stretched PET)). As a result, peeling occurs in the interface between "the transparent support and the image receiving layer". With the interface peeled apart 6 mm, the peeling strength (N/cm) is measured in the same manner as described in Example 1.

For each of the other interfaces, the peeling strength is considered higher than the peeling strength in the interface which is peeled apart and thus measurable in regard to peeling strength. Thus, the measurement of the peeling strength is not carried out on such interfaces.

The measurement results are presented in Table 1.

Further, the transfer sheet b1 and the image recording material (card) b1 are evaluated in the same manner as described in Example 1. The evaluation results are presented in Table 2.

As a result, peeling occurs in the adhesion test using a 19 mm thick polyester adhesive tape (Adhesive strength; 12 N), which is thus evaluated as "C".

TABLE 2

| | | | Example | | | | | | Comparative Example |
|---|---|---|---|---|---|---|---|---|---|
| | | | 1 | 2 | 3 | 4 | 5 | 6 | 1 |
| Bonding layer | Existence | | Yes | Yes | Yes | Yes | Yes | Yes | No |
| | Adhesive layer | | Polyester resin | Polyester urethane resin | Polyester urethane resin | Polyester resin | Polyester resin | Polyester urethane resin | — |
| Evaluation of transfer sheet | Image fixability | | A | A | A | A | A | A | A |
| | Image quality | | A | A | A | A | A | A | A |
| | Conveyability in apparatus | | A | A | A | A | A | A | A |
| Evaluation of image recording material | Adhesion | Adhesive strength 5.6N/19 mm | A | A | A | A | A | A | A |
| | | Adhesive strength 12N/19 mm | A | A | A | A | A | A | D |
| | Image concentration | | A | A | A | A | A | A | A |
| | Friction and wear resistance | | A | A | A | A | A | A | A |
| | Surface resistance to solvent | | A | A | A | A | A | A | A |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image transfer sheet, comprising:

an image receiving layer;

a bonding layer;

a transparent support; and a substrate, in this order, wherein a peeling strength between the transparent support and the substrate is lower than a peeling strength between the image receiving layer and the bonding layer, and between the bonding layer and the transparent support, wherein the image transfer sheet includes an adhesive in a region between the transparent support and the substrate layer, and the adhesive layer contains an acryl-based resin or a silicone-based resin.

2. The image transfer sheet according to claim 1, wherein the bonding layer contains a polyester-based adhesive.

3. An image recording material fabricated by:

forming an image containing an image forming material in a mirror image on a side of the image transfer sheet according to claim 1, the side on which the image receiving layer disposed;

laminating the image transfer sheet on an image support such so as to face a surface on which the image of the image transfer sheet is formed with one side of the image support; and transferring the image receiving layer, the bonding layer, and the transparent support of the image transfer sheet, and the image containing the image forming material onto the image support, by peeling the substrate of the image transfer sheet off the image support, wherein the image recording material includes the image support, the image receiving layer, the bonding layer, and the transparent support in this order, and the image containing the image forming material is provided in a region between the image support and the image receiving layer.

* * * * *